US007875124B2

(12) United States Patent
Berends et al.

(10) Patent No.: US 7,875,124 B2
(45) Date of Patent: Jan. 25, 2011

(54) METHOD FOR PERFORMING WASH CYCLES IN A DISHWASHER

(75) Inventors: Erik Berends, Bielefeld (DE); Joerg Kinnius, Spenge (DE); Stephan Koch, Detmold (DE); Ursula Pieper, Rheda-Wiedenbrueck (DE); Monika Seifert, Detmold (DE); Cornelius Wolf, Bielefeld (DE)

(73) Assignee: Miele & Cie. KG, Guetersloh (DE)

( * ) Notice: Subject to any disclaimer, the term of this patent is extended or adjusted under 35 U.S.C. 154(b) by 171 days.

(21) Appl. No.: 12/108,031

(22) Filed: Apr. 23, 2008

(65) Prior Publication Data

US 2008/0264448 A1 Oct. 30, 2008

(30) Foreign Application Priority Data

Apr. 26, 2007 (DE) ..... 10 2007 020 074

(51) Int. Cl.
*B08B 7/00* (2006.01)
*B08B 3/00* (2006.01)

(52) U.S. Cl. ..... 134/25.2; 134/18; 134/56 D

(58) Field of Classification Search ..... 134/18, 134/25.2, 42, 56 D

See application file for complete search history.

(56) References Cited

U.S. PATENT DOCUMENTS

2003/0079760 A1 * 5/2003 Spanyer et al. ..... 134/18
2005/0126602 A1 6/2005 Rosenbauer
2005/0150260 A1 * 7/2005 Marone et al. ..... 68/17 R
2006/0048795 A1 3/2006 Kornberger et al.

FOREIGN PATENT DOCUMENTS

| | | |
|---|---|---|
| DE | 10049489 | 4/2002 |
| DE | 10220839 | 12/2003 |
| DE | 10230567 | 1/2004 |
| DE | 102004043657 | 3/2006 |
| EP | 1362547 | 11/2003 |
| EP | 1897482 A1 | 3/2008 |
| WO | 2004017807 | 3/2004 |

* cited by examiner

*Primary Examiner*—Michael Kornakov
*Assistant Examiner*—Nicole Blan
(74) *Attorney, Agent, or Firm*—Leydig, Voit & Mayer, Ltd.

(57) ABSTRACT

A method for performing wash cycles in a dishwasher comprising factory includes presetting the dishwasher to an adapted wash cycle as a default cycle, the adopted wash cycle being adapted to a combination product including a detergent agent and at least one of a water-softening agent and a rinse agent. A wash cycle is selected using a control element. Using a cycle controller, the adapted wash cycle is performed until a filling of at least one reservoir with a rinse aid or a water softener salt. Using the cycle controller, a predetermined number of standard wash cycles are performed after the filling of the at least one reservoir.

7 Claims, 1 Drawing Sheet

METHOD FOR PERFORMING WASH CYCLES IN A DISHWASHER

CROSS REFERENCE TO RELATED APPLICATIONS

Priority is claimed to German patent application DE 10 2007 020 074.0, filed Apr. 26, 2007 which is hereby incorporated by reference herein.

FIELD

The present invention relates to a method for performing wash cycles in a dishwasher, in which method a wash cycle is selected via a control element.

BACKGROUND

Besides standard detergents, there is an increasing availability of combination products, called "multiple-in-1" products, for use in dishwashers. 2-in-1 detergents contain a rinse agent in addition to the detergent agent, while 3-in-1 detergents additionally contain a water-softening agent. There are also 4-in-1 and 5-in1 detergents, which contain further components. According to manufacturer specifications, there is no need to use rinse aid or water softener salt when using such products, provided the tap water hardness does not exceed 21° dH. In many cases, this leads to poorer washing and/or drying results. In particular, the rinse performance of combination products frequently does not reach the level of a separately dispensed liquid rinse aid. Therefore, there is a desire to improve washing results by adapting the wash cycles, such as described, for example, in DE 10 2004 043 657 A1 or EP 1 362 547 A2. In German Patent documents DE 100 49 489 A1, DE 102 20 839 A1 and DE 102 30 567 A1, other forms of cycle adaptation are described according to which rinse aid and salt indicators are disabled when not needed.

Basically, when using combination products, the dishwasher must use different cycle sequences than when using standard detergents in order to obtain satisfactory washing and drying results. When using combination products, such differences include the suppression or reduction of the rinse agent supply and regeneration cycles, longer cycle times (especially of the drying step), higher liquid temperatures during the final rinse step, and reduced water changes (suppression of the second intermediate rinse step.

In the dishwashers described in DE 100 49 489 A1, DE 102 20 839 A1 and DE 102 30 567 A1, adapted wash cycles are selected via additional control elements. To this end, the dishwasher of DE 102 20 839 A1 is provided with additional, momentary buttons which can be pressed to select all cycles from the 2-in-1 group or 3-in-1 group that are to be used in the future. This variant is indeed simple in construction, but has the disadvantage that when users switch from combination products to standard detergents, they often forget to release buttons they have pressed before.

Therefore, there is a desire to allow wash cycles to be automatically adapted when combination products are used. European Patent Document EP 1 362 547 A2 describes a way of detecting the detergent type using sensor means. The sensors used are chemical, optical, acoustic, thermal or pneumatic sensors, which analyze the effect of the detergent on the wash liquid and which are intended to detect therefrom the type of product used. This has proved not to be practical because the differences in the degree of soiling of the dishes corrupt the measurement results of the sensors. Moreover, such sensors are expensive and prone to failure, and are therefore not suitable for use in consumer products.

Document WO 2004/017807 A1 describes a method of the aforementioned type in which a standard wash cycle is set as a default cycle and in which, when there is no water softener salt and/or rinse aid available, the dishwasher infers that a combination product is used, and adapts the sequence of the wash cycle accordingly. However, the absence of the aforementioned agents is not an unequivocal sign that combination products are used. The user may also have forgotten to replenish said agents. DE 100 49 489 A1 describes that the rinse aid indicator may be disabled after switching to an adapted cycle. In that case, absence of this agent is not indicated to the user, and wash cycles are performed without the addition of rinse aid, even when using standard detergents.

SUMMARY

In view of the above, an aspect of the present invention is to improve a method for performing wash cycles in a dishwasher by simple and reliable means such that it will use the wash cycle that is adapted to the detergent used.

In an embodiment, the present invention provides a method for performing wash cycles in a dishwasher. The dishwasher is factory preset to an adapted wash cycle as a default cycle, the adopted wash cycle being adapted to a combination product including a detergent agent and at least one of a water-softening agent and a rinse agent. A wash cycle is selected with a control element. Using a cycle controller, the adapted wash cycle is performed until a filling of at least one reservoir with a rinse aid or a water softener salt. Using the cycle controller, a predetermined number of standard wash cycles is performed after the filling of the at least one reservoir.

DETAILED DESCRIPTION

Figure 1:
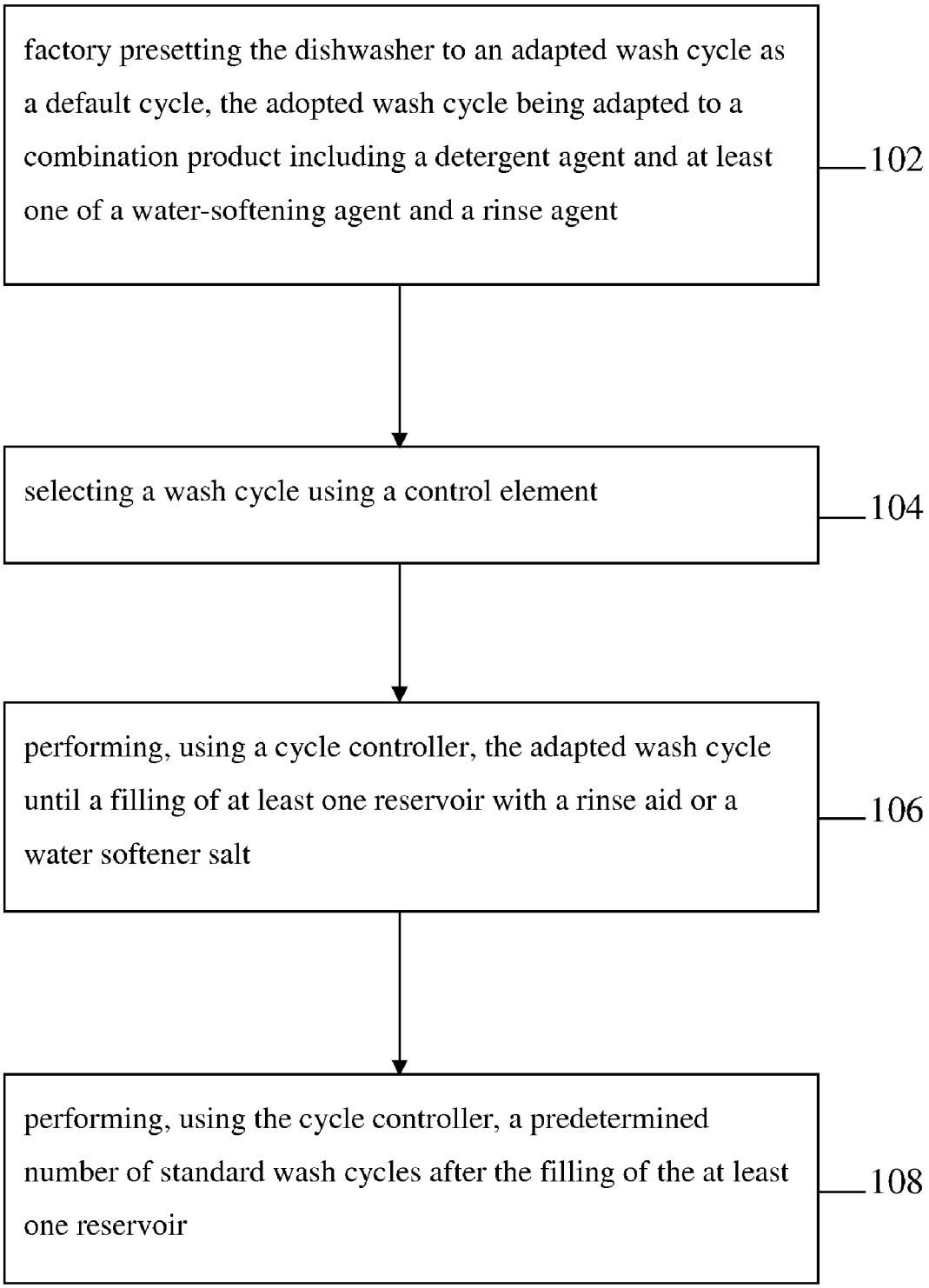
FIG. 1 shows a flow chart of a method according to an embodiment of the present invention.

FIG. 1 shows a flow chart of a method according to an embodiment of the present invention. The method includes factory presetting the dishwasher to an adapted wash cycle as a default cycle, the adopted wash cycle being adapted to a combination product including a detergent agent and at least one of a water-softening agent and a rinse agent (see block 102). A wash cycle is selected with a control element. (see block 104). Using a cycle controller, the adapted wash cycle is performed until a filling of at least one reservoir with a rinse aid or a water softener salt (see block 106). Using the cycle controller, a predetermined number of standard wash cycles is performed after the filling of the at least one reservoir (see block 108).

In an embodiment of the present invention a method is used for performing wash cycles in a dishwasher that are selected by a control element, and then, depending on the fill level of at least one reservoir for storing rinse aid and/or water softener salt, the cycle controller performs either a standard wash cycle or a wash cycle that is adapted to combination products; said combination products containing a detergent agent and, in addition, at least a water-softening agent and/or a rinse agent.

An aspect of the present invention is based on the realization that, assuming incorrect control settings, the washing and drying results obtained when combination products are used in standard wash cycles with the addition of salt and rinse aid are better than those obtained when using standard detergents in adapted wash cycles without the addition of salt or rinse aid. Accordingly, it is advantageous to preset the dishwasher to a wash cycle that is adapted to combination products. This takes into account first of all the increasing use of combination products. Secondly, a user deliberately replenishing the water softener salt or rinse aid is a much more reliable indication of the use of a standard detergent than failing to replenish such additives is an indication of the use of combination products. If the user should switch to another type of detergent while the reservoirs are full, the water softener is still regenerated and rinse aid is still added even though combination products are used, but this will not result in a deterioration of the washing or drying results, as would be the case when performing an adapted wash cycle without also using combination products.

If, upon delivery, the appliance is already equipped with the wash cycle features necessary for the use of combination products (see above), the impaired conditions associated with the absence of salt and rinse aid can be compensated for by the use of such combination products. An LED indicator may be used to indicate to the user that such an adapted wash cycle is being performed. If the user then wishes to use a standard detergent without rinse or water-softening additives, the reservoir(s) for salt and/or rinse aid may be filled. Replenishment is detected by sensors in the reservoir and signaled to the cycle controller. The cycle controller reliably detects that the user wishes to use a standard wash cycle, and uses this standard wash cycle for a predetermined number of cycles of operation. Replenishment detection may be accomplished by float switches disposed in the reservoirs.

In an embodiment of the invention the standard wash cycle is performed only if the salt reservoir and the rinse aid reservoir are filled. This takes into account that when using a standard detergent, satisfactory washing and drying results can only be ensured if both additives are present.

The number of cycles to be performed without adaptation to the use of a combination product is then determined by the cycle controller according to the earliest point at which the rinse aid or the water softener salt is expected to run out, said earliest point being determined by a sensor and/or by user input. Since in most dishwashers, the amount of rinse aid to be dispensed can be set, and because the point at which the water softener needs to be regenerated is dependent on the composition of the water, it is not typical to permanently program the number of cycles to be performed without adaptation. However, this number can be calculated by the cycle controller because the data needed for this purpose is generally known. This data includes the hardness of the water, which is either known from control settings or determined by sensors, as well as the amount of water introduced during operation, which is measured by an impeller flowmeter. In addition, the maximum capacity of the salt reservoir can be stored in a memory. Given this data, the cycle controller can calculate the point at which no salt will be left in the reservoir. The amount of rinse aid to be dispensed is preset at the factory or changed by the user. If the capacity of the rinse aid reservoir is also known, then again, it is possible to calculate the number of the number of cycles after which the supply will be exhausted. The earliest point at which one of the two additives runs out is then used as an indication of the need to switch to the default cycle, i.e., to the adapted wash cycle. When the salt reservoir and the rinse aid reservoir are refilled, the cycle controller will again calculate the number of cycles to be performed without adaptation. Then, the calculated number of cycles will be performed accordingly.

In an embodiment of the invention, at least one low level indicator is turned on before the last of the number of cycles of operation is reached, and the at least one low level indicator is turned off after a predetermined further number of cycles have been performed without filling at least one reservoir with rinse aid or water softener salt. The low level indicator(s) for salt and/or rinse aid is/are turned on during initial operation of the appliance and shortly before the reservoirs are empty, which condition is detected by suitable means. Filling of the reservoirs causes the aforementioned indicators to be deactivated. When the user uses a combination product and, therefore, deliberately fails to fill the reservoirs, the indicators will be turned off by the cycle controller after a predetermined further number of wash cycles, which may be between two and five. Alternatively, the indicators can be turned on, for example in a flashing mode, only at the start or end of a wash cycle, while during operation, they can be turned off. The indicator may also be able to be turned off by the user via a separate control element.

What is claimed is:

1. A method for performing wash cycles in a dishwasher comprising:

factory presetting the dishwasher to an adapted wash cycle as a default cycle, the adapted wash cycle being adapted to a combination product including a detergent agent and at least one of a water-softening agent and a rinse agent;

performing, using a cycle controller, the adapted wash cycle until a filling of a rinse aid reservoir with a rinse aid and a salt reservoir with a water softener salt; and performing, using the cycle controller, a predetermined number of standard wash cycles after the filling of the rinse aid reservoir and salt reservoir, the standard wash cycle being configured for use with the rinse aid and the water softener salt.

2. The method for performing wash cycles as recited in claim 1 wherein when the rinse aid reservoir has been filled with rinse aid and the salt reservoir has been filled with the water softener salt, the method further comprises:

determining, using at least one of a sensor and user input, an earliest point at which one of the rinse aid and the water softener salt is expected to run out; and determining the predetermined number of standard wash cycles based on the determined earliest point.

3. The method for performing wash cycles as recited in claim 1 further comprising, when the rinse aid reservoir has been filled with rinse aid, the salt reservoir has been filled with the water softener salt, and the predetermined number of standard wash cycles have been performed, determining, using the cycle controller, a second number of predetermined standard wash cycles to be performed after a refilling of the salt reservoir and the rinse aid reservoir.

4. The method for performing wash cycles as recited in claim 1 further comprising, when the rinse aid reservoir has been filled with rinse aid and the salt reservoir has been filled with the water softener salt:

turning on at least one low level indicator before a last of the predetermined number of standard wash cycles is performed;

performing a further number of wash cycles after the at least one low level indicator is turned on; and turning off the at least one low level indicator after the further number of wash cycles are performed without a second filling of the rinse aid reservoir and salt reservoir.

5. The method for performing wash cycles as recited in claim 4, wherein the further number of wash cycles is between two and five.

6. The method for performing wash cycles as recited in claim 1 further comprising, when the rinse aid reservoir has been filled with rinse aid and the salt reservoir has been filled with the water softener salt:

turning on at least one low level indicator before a last of the predetermined number of standard wash cycles is performed;

performing a further number of wash cycles after the at least one low level indicator is turned on; and flashing the at least one low level indicator during at least one of a start and an end of a wash cycle after the further number of wash cycles are performed without a second filling of the rinse aid reservoir and salt reservoir.

7. The method for performing wash cycles as recited in claim 6, wherein the further number of wash cycles is between two and five.

* * * * *